United States Patent [19]

Melotik et al.

[11] 4,456,650

[45] Jun. 26, 1984

[54] FRICTION MATERIAL HAVING A COATING COMPRISING ALKANOLAMINE-CARBOXYLIC ACID SALTS

[75] Inventors: Donald J. Melotik, Dearborn Heights; Marvin H. Weintraub, West Bloomfield; Arnold E. Anderson, Livonia, all of Mich.

[73] Assignee: Ford Motor Company, Dearborn, Mich.

[21] Appl. No.: 456,931

[22] PCT Filed: Nov. 22, 1982

[86] PCT No.: PCT/US82/01648

§ 371 Date: Nov. 22, 1982

§ 102(e) Date: Nov. 22, 1982

[51] Int. Cl.[3] ..... B32B 27/00; B32B 9/04; C04B 9/02; F16D 69/00

[52] U.S. Cl. ..... 428/290; 428/443; 428/444; 428/465; 428/457; 428/543; 428/426; 106/14.18; 523/152; 192/107 M; 188/251 H; 427/388.1

[58] Field of Search ..... 428/289, 290, 444, 465, 428/457, 543; 106/14.18; 523/152

[56] References Cited

U.S. PATENT DOCUMENTS

| | | | |
|---|---|---|---|
| 3,326,822 | 6/1967 | Albertson | 428/289 X |
| 3,769,214 | 10/1973 | Davis | 252/34 F |
| 4,045,608 | 8/1977 | Todd | 428/444 X |
| 4,073,618 | 2/1978 | Doi et al. | 106/14.18 X |
| 4,192,769 | 3/1980 | Jahnke | 106/14.18 X |
| 4,233,176 | 11/1980 | Conner, Sr. | 106/14.18 X |
| 4,355,068 | 10/1982 | Beyer et al. | 428/444 X |

OTHER PUBLICATIONS

"Sodium Replacement–The State of the Art," C. J. Fette, Journal of the American Society of Lubrication Engineers, vol. 35, 11, 625–627.

"Anti Corrosion Paper", Ikhelson et al.; Chemical Abstracts, vol. 93, 1980 93:169993g.

"Composition for Impregnating a Base Paper Used for Manufacture of Anticorrosion Paper" Ikhelson et al.; Chemical Abstracts, vol. 93, 1980, 93:169994h.

"Corrosion Inhibition of Metal Products Stored in Open Atmosphere", Jpn Kokai Tokkyo; Chemical Abstracts, vol. 93, 1980, p. 224, 93:136155g.

"Fire-Resistant Acrylic Fibers and their Products" Kazuo et al., Chemical Abstracts, vol. 77, 1972, p. 66, 127990t.

"Liquid Temporary Corrosion–Inhibiting and Cleaning Surface Treating Agents Having a High Water Tolerance for Metals, Especially Steel", Atterby; Chemical Abstracts, vol. 78, 1973, pp. 191–192, 78:46588m.

"Corrosion Test of Various Derivatives of Aromatic Carboxylic Acids", Saga et al., Chemical Abstracts, vol. 91, 1979, p. 193, 91:110903h.

"Corrosion–Inhibiting Compositions for Metal Working", Martin et al., Chemical Abstracts, vol. 84, 1976, p. 177, 84:470009.

*Primary Examiner*—P. C. Ives

*Attorney, Agent, or Firm*—Lorraine S. Melotik; Roger L. May

[57] ABSTRACT

A method for using alkanolamine-carboxylic acid salts as a coating for friction materials which during use contact, at least part of the time, rustable metals. The method comprises contacting the friction material with an aqueous solution comprising at least about 0.05 weight alkanolamine-carboxylic acid salts being the reaction product of:

(i) alkanolamine; and (ii) $C_4$–$C_{20}$ carboxylic acid;

and thereafter evaporating water from the aqueous coating on the friction material so as to leave the friction material with a coating comprising alkanolamine-carboxylic acid salts. Friction materials coated by above method are also claimed.

9 Claims, No Drawings

FRICTION MATERIAL HAVING A COATING COMPRISING ALKANOLAMINE-CARBOXYLIC ACID SALTS

TECHNICAL FIELD

The method of this invention relates to the use of alkanolamine-carboxylic acid salts as coatings for friction materials which during use, contact rustable metals. More particularly, the friction material is contacted with an aqueous solution comprising at least about 0.05 weight percent, based on the weight of the solution, alkanolamine-carboxylic acid salts and subsequently dried to remove water, leaving a coating comprising alkanolamine-carboxylic acid salts on the friction material.

BACKGROUND ART

During use, friction materials, such as brake linings or clutch facings, come in contact with metals, e.g., cast iron. Corrosion of such ferrous metals may cause adhesion (stiction) of the friction material to the metal when they are allowed to contact one another for a period of time. Generally, such corrosion and stiction occur before the metal and friction material have received substantial sustained wear. One longstanding approach to preventing clutch facing stiction comprises coating the friction material with sodium nitrite. However, recent and anticipated agency recommendations have created a need to replace sodium nitrite which is ecologically less than desirable. It also does not appear to retain its corrosion resistant properties longer than a few weeks (often before the friction material is operating on the vehicle), oxidizing at ambient temperatures to the nitrate. However, we have found that coatings comprising alkanolamine-carboxylic acid salts on friction materials are significantly more effective in preventing such corrosion bonding and that they maintain these properties after application and during friction material use for a substantially greater period of time.

Alkanolamine-carboxylic acid salts have been used as flame retardants in acrylic fibers, however more usually as corrosion inhibitors in lubricants, cutting fluids, radiator coolants, and metal surface cleaning-treating compositions. U.S. Pat. No. 3,769,214 to Davis teaches aqueous compositions, adapted for use as coolants and lubricants in metal machining operations, comprising alkanolamine salts of carboxylic acids.

DISCLOSURE OF THE INVENTION

The invention is directed to a method for using alkanolamine-carboxylic acid salts as a coating for friction materials which during use contact rustable metals. The coating on the friction material acts to prevent corrosion or corrosion product build up on the metal contacting the friction material. The method of this application comprises:

(A) contacting the friction material with an aqueous solution comprising at least about 0.05, preferably between about 0.1 and about 10.0, most preferably between about 0.2 and about 5.0 weight percent, based on the weight of the solution, of alkanolamine-carboxylic acid salts; and (B) evaportating water from aqueous coating on the friction material so as to leave the friction material with a coating comprising alkanolamine-carboxylic acid salts.

The alkanolamine-carboxylic acid salts are the reaction product of alkanolamines, preferably selected from secondary and tertiary alkanolamines, and $C_4$–$C_{20}$, preferably $C_6$–$C_{10}$, carboxylic acids. More preferably, the alkanolamine reactant used to form the salt is a secondary alkanolamine, most preferably being diethanolamine. The carboxylic acid reactant may be selected from aliphatic and aromatic carboxylic acids or mixtures thereof. Preferably the salts comprise mixtures of alkanolamine-aliphatic carboxylic acid salts and alkanolamine-aromatic carboxylic acid salts, wherein additionally more preferably this mixture contains greater than about 50 percent of the aromatic carboxylic acids salts. Most preferably, the carboxylic acid reactant of the salts are benzoic acid and heptanoic acid.

The invention is also directed to friction materials coated according to the method disclosed above.

Advantageously, the salts can be applied to the friction material at very low concentrations and provide superior prevention of such corrosion related phenomena as stiction.

The alkanolamine-carboxylic acid salts of this invention also exhibit excellent compatibility with dust suppressants commonly employed for use with friction materials.

BEST MODE FOR CARRYING OUT THE INVENTION

The method of this invention can be used with any friction material. In general, friction materials contain a matrix of binder, such as thermosetting resin or vulcanized rubber, a fibrous reinforcement, and friction modifiers. Commonly employed fibers include asbestos, glass and steel wool, while metals, metal oxides, cashew and rubber particles are often employed as friction modifiers. Fillers or extenders may be included to modify physical characteristics and reduce cost.

The method of the present invention is directed to coating any friction material which during use contacts, at least for a time, rustable metals. The corrosion of such metals may result, for example, from exposure to salt water, high humidity, etc. One such embodiment, which was mentioned above, comprises coating clutch facing materials in order to prevent stiction which may occur when the clutch facing rests against the clutch pressure plate or engine flywheel, particularly as mentioned above, at a time before the friction material and metal have received sustained wear. It appears that with sustained wear, surface characteristics of the friction material and the metal are modified so as to significantly decrease the likeihood of stiction occurring. Another embodiment of the method of the present invention comprises providing a coating comprising alkanolamine-carboxylic acid salts on brake linings, for example, to prevent corrosion build up (also known as rust-jacking) on the portion of the shoe adjacent to the lining. Other applications of the method of this invention to prevent corrosion would be apparent to those skilled in the art.

The inhibitor salts employed in the method of this application, i.e., the alkanolamine-carboxylic acid salts are salts of alkanolamine and $C_4$–$C_{20}$ carboxylic acids as disclosed above. The alkanolamine reactant used to form the salt can be any primary, secondary or tertiary alkanolamine or the salt may comprise a salt mixture thereof. Generally, it is preferable that the alkanol moiety of the alkanolamine be selected from $C_1$–$C_6$ aliphatic groups, which may be unsubstituted or substituted with non-interfering functionality, and in the case of secondary and tertiary alkanolamines, the alkane moities may be the same or different $C_1$–$C_6$ groups. Suitable examples of such moieties include, but are not limited to ethanol, 1-isopropanol, 2-amino-2-methyl propanol, and butanol, with ethanol being most preferred. A preferred salt mixture comprises salts of secondary and tertiary alkanolamines, however, more preferably the salts are those of secondary alkanolamines, most preferably, of dialkanolamines. The carboxylic acid reactant used to form the salts employed in this invention may be aliphatic or aromatic, branched or linear, and may be unsubstituted or substituted with non-interfering functionality. Preferably the salts comprise a mixture of salts of aliphatic carboxylic acids and aromatic carboxylic acids, wherein more preferably the aromatic carboxylic acids comprise greater than about 50% of the mixture of the amine-acid salts. Most preferably, the inhibitor salts comprise salts of benzoic acid and heptanoic acid, so that the most preferred salt mixture comprises diethanolamine benzoic acid salt and heptanoic acid salt, the former being in excess. It is believed that these salts could be represented respectively by the following formulas: $C_6H_5COO^- + H_2N(C_2H_4OH)_2$ and $C_6H_{13}COO^- + HN(C_2H_4OH)_2$.

The aqueous solution of the alkanolamine-carboxylic acid salts comprises at least about 0.05, preferably between about 0.1 and about 10.0, most preferably between about 0.2 and about 5.0 weight percent amine-acid salts. In embodiments of the subject invention wherein, for example, clutch facings are coated to prevent stiction, it is generally preferable to employ aqueous solutions comprising between about 0.1 and about 5.0, more preferably between about 0.2 and about 0.2 weight percent amine-acid salts, based on the weight of the solution. It has been found that for such applications, concentrations that give a reactive salt concentration of about 1–10 gms/$m^2$ are particularly useful. However, in coating brake friction materials so as to prevent corrosion build up on the attached metal (i.e., to eliminate rust-jacking), it is preferable to employ an aqueous solution comprising between about 5.0 and 10.0 weight percent alkanolamine-carboxylic acid salts, based on the weight of the aqueous solution. As would be apparent to one skilled in the art, optimal concentration of the inhibitor salt solution to be employed would depend, in part, on the particular intended use of the coating, as well as application techniques, etc. Selection of optimal solution coating concentration would be within the skill of those in the art.

Representative of the various alkanolamine-carboxylic acid salts falling within the above formula are, for example, those commercially available from Keil Chemical Division, Ferro Corp., (Hammond, Indiana) under the tradename Synkad-305 or from Mazer Chemical Industries (Gurnee, Illinois), as a concentrate of the salt in water generally comprising about 20–95 weight percent inhibitor salts. The concentrate may be suitably diluted for use in the method of the invention of this application.

The aqueous solution containing the alkanolamine-carboxylic acid salts of this method may also include other materials conventionally employed in such coating. These may include wetting agents, e.g., non-ionics or organic phosphate esters, dyes, and antioxidants, e.g., amines, particularly trialkanolamines, which additives are generally employed at up to about 1 weight percent, based on solution weight. Other materials such as dust suppressants, e.g., acrylates, sodium silicates or polyvinyl alcohol (PVA) may be included, generally in amounts up to about 15 weight percent, based on solution weight. While the dust suppressant is preferably included in the aqueous inhibitor salt solution, the dust suppressant may also be employed as a separate coating composition to be employed before, however preferably after, coating of the friction material with the aqueous solution comprising the alkanolamine-carboxylic acid salts. It has also been found preferable, when employing separate coatings (two step) of a dust suppressant solution and a alkanolamine-carboxylic acid salt solution, to subject the friction material to the dust suppressant coating solution for a shorter period of time than that of the salt solution coating during respective coating applications thereof.

The aqueous solution comprising the alkanolamine-carboxylic acid salts may be applied as a coating to the friction material by any known method such as spraying, flow coating, roll coating or immersion or like techniques. Selection of optimal coating technique would be well within the skill of those in the art, and depends, for example, on friction material size, porosity, processing parameters, etc. The coating may be applied so as to be adsorbed on and absorbed into the friction material in any desired amount. Penetration (absorption) of the coating into the friction material to between about 0.5–1.0 mm of depth for clutch facings, for example, has been found suitable to prevent stiction. Coatings applied, on the other hand, to prevent rust-jacking e.g., on semi-metallic friction materials, are generally suitably applied to lower penetration depths. Penetration into the friction material would depend, in part, on the physical properties of the friction materials, including its porosity, a condition of manufacture (e.g., molding conditions).

After coating the friction material according to the method of this invention, water is allowed to evaporate from the aqueous coating on the friction material so as to leave a coating of alkanolamine-carboxylic acid salt on the friction material. This may be done by drying the friction material at ambient temperatures or at elevated temperatures, or by a combination of both ambient and elevated temperature drying operations. While it is preferable to allow evaporation of essentially all of the water present in the aqueous coating on the friction material, it is not necessary to do so. The optimal amount of water to be evaporated would depend on intended application, processing conditions, etc., of the coated friction material and thus selection of this optimal amount of water to be removed would be within the skill of those in the art.

These alkanolamine amine-carboxylic salts may be prepared by blending the alkanolamine and carboxylic acid in stoichiometric proportions in water at room temperature. Alternately, the salt may be formed by such combination at elevated temperatures. These reaction conditions described are merely meant as exemplary and are not meant to be limiting to the method of this invention.

The following examples are presented by way of description of the process of the invention and set forth the best mode contemplated by the inventors but are not to be construed as limiting.

EXAMPLE 1

A 1.0% by weight solution of Keil Synkad 305 (approximately 25–30% by weight alkanolamine-carboxylic acid salt) is prepared by adding 10 grams of the material to 990 g of water.

25 mm square smaples of Beral K208-1 142K-81, a non-asbestos clutch friction material, are then coated utilizing the following process cycle:

Cycle I 1.0% by weight Keil Synkad 305 0.3 minute immersion ambient temperature

Air dry approximately 15 minutes at ambient temperature

Oven dry 25 minutes at 104° C.

The samples are evaluated for stiction using a rust adhesion test procedure developed at Ford Motor Company Scientific Research Laboratories.

The test procedure is as follows:

25 mm square clutch facing samples are clamped (175–250 N pressure) into 1.0 ml pools of a 5% by weight aqueous sodium chloride (NaCl) solution on a precleaned cast iron test plate (the salt solution is delivered by syringe). (The cast iron test plate was cleaned by low speed sanding with 150 grit, followed by 320 grit abrasives. It is then wiped clean with anhydrous alcohol (ethanol), then acetone, and air dried.)

The entire assembly is sealed in a polyethylene bag with an open breaker containing approximately 100 ml of a 5.0% by NaCl solution and left overnight (16 hours). The assembly is carefully removed from the bag and gently dried at cast iron temperatures at or below 43° C. until dry (approximately) 2 hours at 43° C., 4 hours at 27 C. Care is taken to avoid thermally or mechanically shocking the assembly. The clamps are cautiously removed to avoid disturbing the samples.

Shear stress measurements are taken utilizing a force gauge (compression type, 500 N capacity, in 5 N or smaller increments). These measurements are made by placing the push rod which is attached to the force gauge against a side of the friction material. Force is applied until lateral displacement of the test sample occurs along the test plate. This force is recorded in N. Stiction Shear Stress Values (S.S.S.) are subsequently determined in Pa for the samples.

Beral K 208-1 142K-81 from Cycle I tested utilizing the aforementioned procedure has average stiction shear stress (S.S.S.) values of 17 kPa. Untreated samples exhibit average S.S.S. values of 56 kPa.

EXAMPLE 2

25 mm square Nuturn FB-2 NAFC 18 non-asbestos clutch friction material samples are treated according to the following cycle:

Cycle II

Keil Synkad 305 1.0 weight percent 60 second immersion ambient temperature

Air Dry approximately 15 minutes at ambient temperature

Oven Dry 25 minutes at 103° C.

Utilizing the rust adhesion test procedure described in Example 1, average stiction shear stress (S.S.S.) values of 7 kPa are obtained for the treated samples. Samples similarly prepared and tested, except utilizing the Keil Synkad 305 concentrations of 0.1% and 0.5 wt. %, have average S.S.S. values of 40 kPa and 21 kPa, respectively.

Untreated Nuturn FB-2 NAFC 18 samples have average S.S.S. values of 280 kPa.

EXAMPLE 3

25 mm square samples of Raybestos Manhattan (R-M) US M 969X, an asbestos bearing clutch friction material are treated as in Example 1.

The average S.S.S. values are 7 kPa for the above samples. Untreated R-M US M969X samples are similarly tested and have average S.S.S. values of 98 kPa.

EXAMPLE 4

(a) Utilizing a two step coating process, an alkanolamine-carboxylic acid salt corrosion inhibitor solution and a sodium silicate (water glass) dust suppressant solution are applied to 25 mm square R-M US 969X clutch friction material samples by the process described below:

Cycle III

Keil Synkad 305 1.0 weight percent 60 second immersion ambient temperature

Air Dry approximately 10 minutes at ambient temperature

Oven Dry 10 minutes at 105° C.

Air Cool 15 minutes at ambient temperature

Sodium Silicate 40°–42° Baume 10% by volume 30 second immersion ambient temperatures Air Dry approximately 10 minutes Oven Dry 25 minutes at 105° C.

Sodium silicate solution was prepared by adding 40 ml 40°–42° Baume sodium silicate (available from M.C.B. Manufacturing Chemists Corp., Cincinatti, Ohio) (~ 5% by weight) to 360 ml of water. After testing as described in Example 1, the average S.S.S. values for the above samples is 3 kPa.

(b) A single solution (Solution II) was utilized which comprised the dust suppressant and corrosion inhibitor used in Example 4*a*.

Solution II was prepared by adding 40.0 ml 40°–42° Baume sodium silicate (~ 5.0 wt. %) and 4.0 ml Synkad 305 (~ 1.0 wt. %) to 356 ml water.

25 mm square samples of R-M US 969X clutch friction material are treated according to the following cycle:

Cycle IV

Solution II—60 second immersion ambient temperature

Air Dry—10 minutes at ambient temperature

Oven Dry—25 minutes at 105° C.

The clutch samples are then tested as in Example 1. The average S.S.S. values are 5 kPa.

Untreated R-M US 969X samples have average S.S.S. values of 98 kPa.

EXAMPLE 5

25 mm square samples of Thermoid 219 X 146 CL 6TL 7549C ANF clutch friction material are treated with known corrosion inhibitors utilizing the following cycle:

Cycle V

Corrosion inhibitor—30 sec. immersion ambient temperature

Oven Dry—10 minutes at 100° C.

The corrosion inhibitors utilized along with the average S.S.S. values observed during testing are listed below. When the corrosion inhibitor was:

sodium tetraborate decahydrate 10% by wt. aqueous solution, average S.S.S. values were 77 kPa sodium nitrite aqueous solutions of 5% and 15% by wt. average S.S.S. values were 85 and 125 kPa, respectively

EXAMPLE 6

Thiokol 1959 4715 and Bendix 7161A semimetallic disc brake friction materials were treated using the following cycle.

Keil Synkad 305—1% by weight 30 second immersion ambient temperature

Air Dry—10 minutes

Oven Dry—25 minutes at 100° C.

The pads were then riveted to cold rolled steel brake shoes and corrosion tested (modified Ford Arizona Proving Ground Test) in a humidity cabinet with periodic application of 5.0 wt. % aqueous sodium chloride solution to the friction material/shoe interface.

The brake shoe assemblies were afforded excellent corrosion protection at the interface, after 5 weeks accelerated testing.

INDUSTRIAL APPLICABILITY it will be obvious from the foregoing that this invention has industrial applicability to vehicles having friction materials in contact with rustable metals and provides a coating for the friction material to prevent corrosion related problems.

In view of this disclosure, many modifications of this invention will be apparent to those skilled in the art. It is intended that all such modifications which fall within the true scope of this invention be included within the terms of the appended claims.

We claim:

1. A friction material, which during use contacts rustable metal, having a coating comprising alkanolamine-carboxylic acid salts which are the reaction product of:

(i) one or more alkanolamines; and (ii) one or more $C_4$–$C_{20}$ carboxylic acids.

2. A friction material according to claim 1, wherein (i) said alkanolamine reactant is selected from the group consisting of primary, secondary and tertiary alkanolamines and (ii) the alkanol moiety of said alkanolamine reactant is selected from $C_1$–$C_6$ aliphatic alkanol moieties.

3. A friction material according to claim 2, wherein said salts are selected from the group consisting of secondary alkanolamine-carboxylic acid salts, tertiary alkanolamine-carboxylic acid salts, and mixtures thereof.

4. A friction material according to claim 2, wherein said alkanolamine reactant consists of secondary alkanolamine.

5. A friction material according to claim 4, wherein said secondary alkanolamine reactant is diethanolamine.

6. A friction material according to claim 1, wherein said carboxylic acid reactant is selected from the group consisting of $C_6$–$C_{10}$ aromatic carboxylic acids and $C_6$–$C_{10}$ aliphatic carboxylic acids.

7. A friction material according to claim 6, wherein said salts comprise a mixture of alkanolamine aliphatic carboxylic acid salts and alkanolamine aromatic carboxylic acid salts.

8. A friction material according to claim 7, wherein greater than about 50% of said mixture comprises alkanolamine-aromatic carboxylic salts.

9. A friction material according to claim 6, wherein said friction materials are selected from clutch facings and brake friction materials.

* * * * *